US011428065B2

(12) United States Patent
Chen et al.

(10) Patent No.: US 11,428,065 B2
(45) Date of Patent: Aug. 30, 2022

(54) BOREHOLE WALL RESISTANCE INCREASING APPARATUS FOR IMPROVING ENERGY UTILIZATION RATE OF INJECTION GAS

(71) Applicant: PetroChina Company Limited, Beijing (CN)

(72) Inventors: Xinglong Chen, Beijing (CN); Qingxin Song, Beijing (CN); Zhidong Yang, Beijing (CN); Shanyan Zhang, Beijing (CN); Zemin Ji, Beijing (CN); Yulong Pu, Beijing (CN)

(73) Assignee: Petrochina Company Limited, Beijing (CN)

( * ) Notice: Subject to any disclaimer, the term of this patent is extended or adjusted under 35 U.S.C. 154(b) by 35 days.

(21) Appl. No.: 16/824,966

(22) Filed: Mar. 20, 2020

(65) Prior Publication Data

US 2021/0040827 A1 Feb. 11, 2021

(30) Foreign Application Priority Data

Aug. 5, 2019 (CN) ..... 201910715841.3

(51) Int. Cl.
*E21B 43/12* (2006.01)
*E21B 43/08* (2006.01)
(Continued)

(52) U.S. Cl.
CPC ..... *E21B 33/124* (2013.01); *E21B 34/063* (2013.01); *E21B 43/08* (2013.01);
(Continued)

(58) Field of Classification Search
CPC ..... E21B 43/32; E21B 43/12; E21B 34/063; E21B 27/02; E21B 33/138
See application file for complete search history.

(56) References Cited

U.S. PATENT DOCUMENTS 5,507,345 A * 4/1996 Wehunt, Jr. ..... E21B 33/124 166/285
6,679,324 B2 * 1/2004 Den Boer ..... E21B 34/066 137/827
(Continued)

FOREIGN PATENT DOCUMENTS

CN 201874544 U 6/2011
CN 106089163 A 11/2016
(Continued)

OTHER PUBLICATIONS

Chinese Search Report with English translation dated Jul. 11, 2019.

*Primary Examiner* — Robert E Fuller
*Assistant Examiner* — Theodore N Yao
(74) *Attorney, Agent, or Firm* — Ruggiero McAllister & McMahon LLC

(57) ABSTRACT

A method and an apparatus for oil production by increasing resistance of borehole wall for improving an energy utilization rate of injection gas includes injecting gas into an oil reservoir so that a gas pressure in the oil reservoir reaches an initial oil reservoir pressure. The initial oil seepage pressure is present at a position where the inside of the production well is in communication with the oil reservoir. The initial oil seepage pressure is less than the initial oil reservoir pressure. The method also includes monitoring gas production and oil production of the production well and increasing the initial oil seepage pressure to an increased oil seepage pressure when a ratio of the gas production to the oil production is higher than a predetermined ratio. The increased oil seepage pressure is smaller than the initial oil reservoir pressure.

9 Claims, 9 Drawing Sheets

(51) Int. Cl.

| | |
|---|---|
| ***E21B 33/124*** | (2006.01) |
| ***E21B 43/16*** | (2006.01) |
| ***E21B 43/38*** | (2006.01) |
| ***E21B 34/06*** | (2006.01) |

(52) U.S. Cl.
CPC ..... *E21B 43/12* (2013.01); *E21B 43/123* (2013.01); *E21B 43/168* (2013.01); *E21B 43/38* (2013.01)

(56) References Cited

U.S. PATENT DOCUMENTS

| | | | | |
|---|---|---|---|---|
| 2002/0014333 | A1* | 2/2002 | Ohmer | E21B 7/061 166/50 |
| 2010/0300688 | A1* | 12/2010 | Panga | E21B 43/04 166/280.2 |
| 2015/0060084 | A1* | 3/2015 | Moen | E21B 43/12 166/373 |
| 2015/0240587 | A1* | 8/2015 | Peterson | E21B 33/1208 166/296 |
| 2015/0267500 | A1* | 9/2015 | Van Dongen | E21B 33/14 277/336 |
| 2017/0218736 | A1* | 8/2017 | Liu | E21B 43/08 |
| 2018/0298719 | A1* | 10/2018 | Karadkar | C04B 26/16 |
| 2020/0399982 | A1* | 12/2020 | Warren | E21B 34/14 |

FOREIGN PATENT DOCUMENTS

| | | | |
|---|---|---|---|
| CN | 109209306 | A | 1/2019 |
| RU | 2613689 | C1 | 3/2017 |
| WO | 2011099888 | A1 | 8/2011 |

* cited by examiner

BOREHOLE WALL RESISTANCE INCREASING APPARATUS FOR IMPROVING ENERGY UTILIZATION RATE OF INJECTION GAS

CROSS-REFERENCE TO RELATED APPLICATION

This application claims priority to Chinese Patent Application No. 201910715841.3, filed on Aug. 5, 2019, which is hereby incorporated herein by reference in its entirety.

TECHNICAL FIELD

The present disclosure relates to the technical field of oilfield development, and in particular to a method and an apparatus for oil production by increasing resistance of borehole wall for improving an energy utilization rate of injection gas.

BACKGROUND

At present, the low-permeability and ultra-low-permeability reservoirs are developed mainly by water injection, but the low permeability leads to problems of difficult injection and low recovery and the like. Because of easy injection of gas, a gas injection technology has been applied more and more in this kind of reservoir. Compared with water injection, gas injection development has two advantages. One of the advantages is that seepage resistance of the gas is small, and the gas can enter low permeability pores that the injection water cannot enter under relatively low pressure, thus expanding the swept volume; the other of the advantages is that the gas accumulates in the pores of the reservoir, and under the action of the difference in density between oil and gas, when certain seepage conditions are met, the gas accumulates at the top of the reservoir and slowly drives the crude oil downward, which is the core feature of a gas flooding technology, and whether or not the technology can play its role is the key to enhance oil recovery.

However, the easy injection of gas will also have adverse effects in the development process, that is, the gas will easily migrate along a high permeability strip (the dominant seepage channel formed by water injection) and form gas channeling phenomenon. Under the existing conditions, after gas channeling is formed, the oil wells are basically in a stagnation state, and the increase range of the crude oil recovery degree is limited.

In the existing gas channeling prevention technology, one method is to reduce the pressure of the injection well and block the gas channeling channel. This not only loses the energy of the injected gas, but also it is difficult to achieve a good blocking effect. Another method is to add devices such as a gas anchor or the like into a production well, but the gas anchor functions only to separate gas and liquid in the wellbore, which can not prevent gas channeling itself. Therefore, how to reduce the occurrence of gas channeling and improve oil recovery has become an urgent problem in this field.

SUMMARY

The object of the present disclosure is to provide a method and an apparatus for oil production by increasing resistance of borehole wall for improving an energy utilization rate of injection gas, which can effectively reduce gas channeling phenomenon and improve oil production.

In order to achieve the above object, the present disclosure provides a method for oil production by increasing resistance of borehole wall for improving an energy utilization rate of injection gas, wherein the method comprises: injecting gas into an oil reservoir so that a gas pressure in the oil reservoir reaches an initial oil reservoir pressure, under the action of which the gas in the oil reservoir displaces the oil in the oil reservoir to seep into inside of a production well; an initial oil seepage pressure being present at a position where an inside of the production well is in communication with the oil reservoir, the initial oil seepage pressure being less than the initial oil reservoir pressure; monitoring gas production and oil production of the production well; and increasing the initial oil seepage pressure at the position where the inside of the production well that is in communication with the oil reservoir to an increased oil seepage pressure, when a ratio of the gas production to the oil production is higher than a predetermined ratio, wherein the increased oil seepage pressure is smaller than the initial oil reservoir pressure.

In order to achieve the above object, the present disclosure also provides a borehole wall resistance increasing apparatus for improving an energy utilization rate of injection gas, for implementing the method for oil production by increasing resistance of borehole wall for improving an energy utilization rate of injection gas as described above, provided at the position where the inside of the production well is in communication with the oil reservoir, comprising an upper packer, a resistance increasing mechanism, and a lower packer connected sequentially from top to bottom, wherein the resistance increasing mechanism includes: a connecting pipe having an upper end connected to the upper packer and a lower end connected to the lower packer, and provided radially thereon with a plurality of through holes; and a resistance increasing sleeve within which the connecting pipe is arranged, the resistance increasing sleeve covering the through holes, the oil passing through the resistance increasing sleeve in a radial direction of the resistance increasing sleeve, and the resistance increasing sleeve can improve the resistance experienced by the oil during the flow and has an upper end and a lower end both being closed.

Compared with the prior art, the present disclosure has advantages as follows:

With the method and the apparatus for oil production by increasing resistance of borehole wall for improving an energy utilization rate of injection gas provided by the present disclosure, when the gas channeling phenomenon occurs, the pressure required for gas channeling flow is increased by increasing the oil seepage pressure at a position inside the production well that is in communication with the oil reservoir, so as to reduce occurrence of the gas channeling phenomenon, at the same time the channeling gas is forced to accumulate in the oil reservoir to compress and displace more oil and increase oil production.

BRIEF DESCRIPTION OF THE DRAWINGS

The following drawings are intended only to schematically illustrate and explain the present disclosure and do not limit the scope of the present disclosure.

DETAILED DESCRIPTION OF THE PREFERRED EMBODIMENT

For a clearer understanding of the technical solutions, objects and effects of the present disclosure, specific embodiments of the present disclosure will now be described with reference to the accompanying drawings.

Embodiment 1

Figure 1:
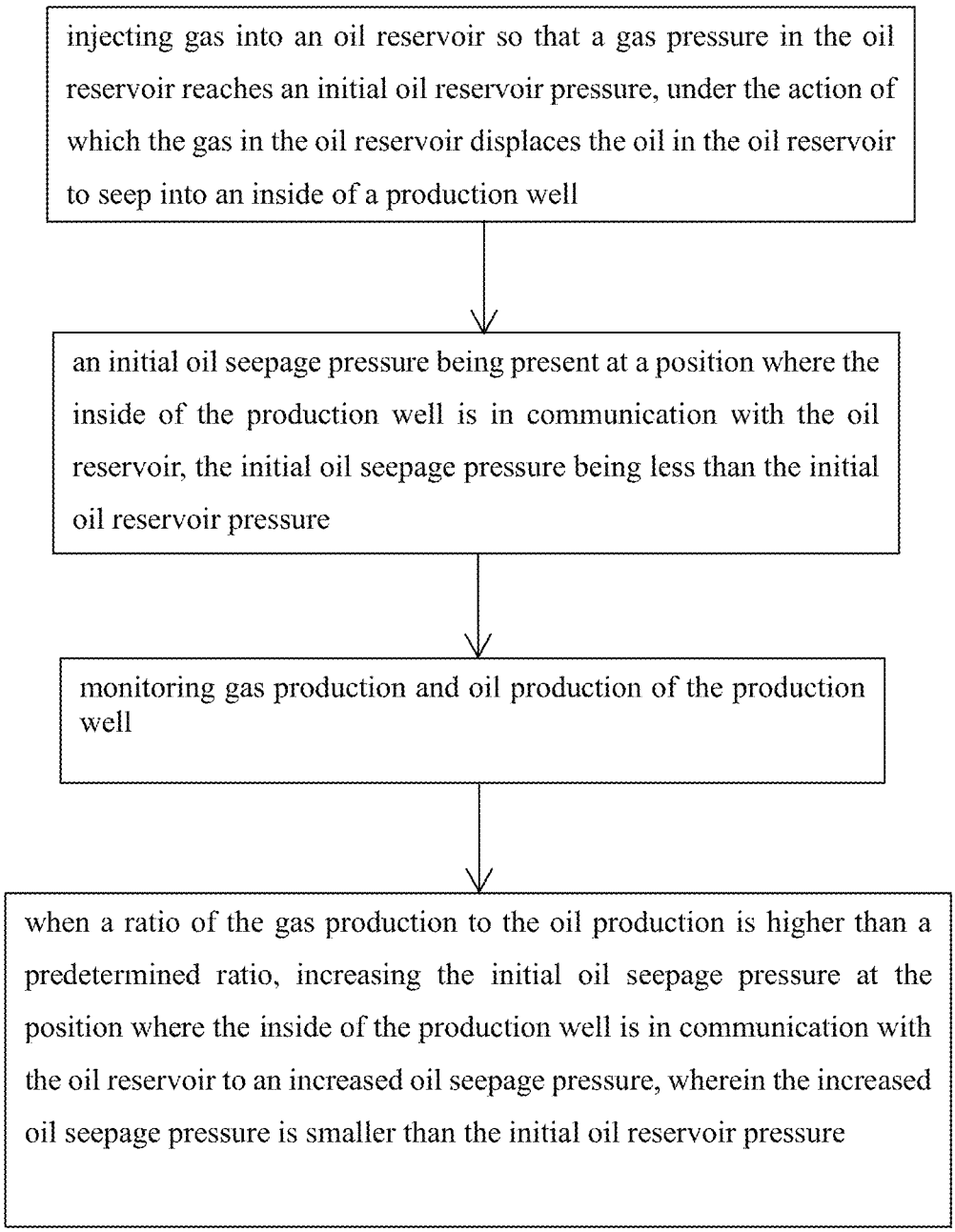
FIG. 1 is a flow chart of a method for oil production by increasing resistance of borehole wall for improving an energy utilization rate of injection gas according to an embodiment 1 of the present disclosure.
Figure 11:
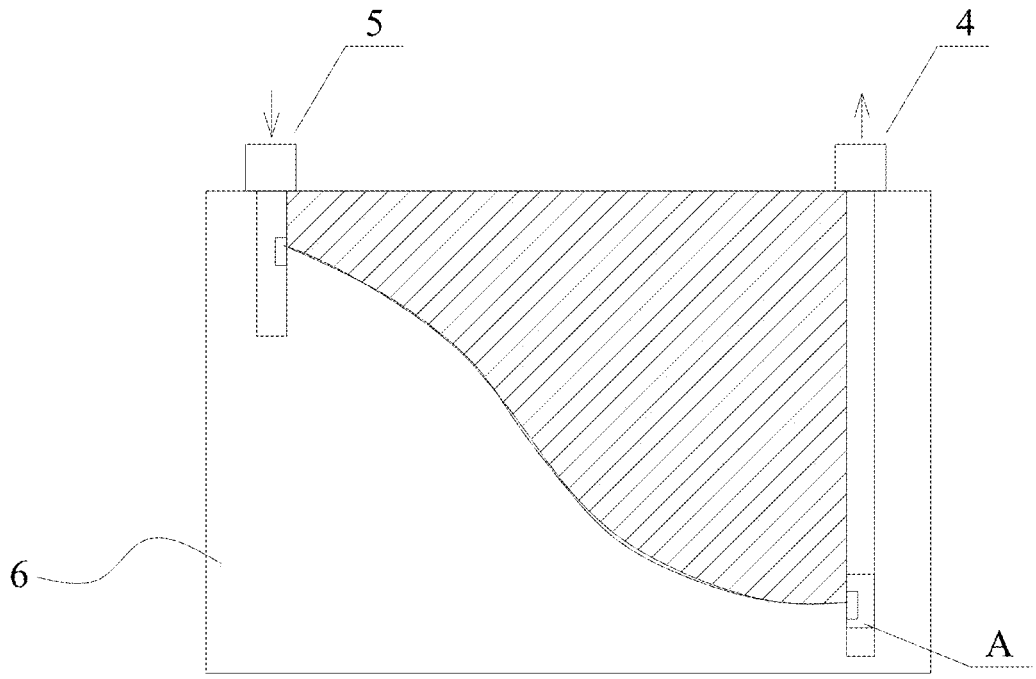
FIG. 11 is a schematic diagram of the reservoir development effect with the application of the method and the apparatus for oil production by increasing resistance of borehole wall for improving an energy utilization rate of injection gas according to the present disclosure.

As shown in FIGS. 1 and 11, the present disclosure provides a method for oil production by increasing resistance of borehole wall for improving an energy utilization rate of injection gas, which may also be referred to as a method for oil production by increasing in-well resistance for improving an utilization rate of injection gas. Specifically, a pressure of the product in the oil reservoir seeping into the production well is increased by performing operation at a position on an inner wall of an oil well casing of the production well that is in communication with the oil reservoir, so that the gas injected into the oil reservoir accumulates inside the oil reservoir, the pressure in the oil reservoir is maintained, and the gas channeling phenomenon is reduced, that is, the utilization rate of the gas injected into the oil reservoir is improved, wherein the method for oil production by increasing resistance of borehole wall for improving an energy utilization rate of injection gas comprises: injecting gas into an oil reservoir 6 (through a gas injection well 5) so that the gas pressure in the oil reservoir 6 reaches an initial oil reservoir pressure, under the action of which the gas in the oil reservoir 6 displaces the oil (i.e., crude oil) in the oil reservoir 6 to seep into inside of the production well to start producing oil; an initial oil seepage pressure being present at a position where an inside of the production well is in communication with the oil reservoir 6, the initial oil seepage pressure being less than the initial oil reservoir pressure, to ensure that the oil in the oil reservoir 6 can smoothly seep into the inside of the production well under the action of the initial oil reservoir pressure; monitoring gas production and oil production of the production well; when a ratio of the gas production to the oil production is higher than a predetermined ratio, indicating the occurrence of gas channeling, at this time, increasing an oil seepage pressure at the position wherein the inside of the production well is in communication with the oil reservoir 6, so as to cause an increased oil seepage pressure at the position where the inside of the production well is in communication with the oil reservoir 6, i.e. increasing the initial oil seepage pressure at the position where the inside of the production well is in communication with the oil reservoir 6 to the increased oil seepage pressure, such that the gas needs higher pressure to overcome the increased oil seepage pressure to continue channeling, thereby forcing the channeling gas to accumulate in the oil reservoir 6 to compress and displace more oil, so as to enlarge the swept (displacing) volume and increase the oil production. It is noted that the increased oil seepage pressure is lower than the initial oil reservoir pressure to ensure that the oil in the oil reservoir 6 can seep into the inside of the production well smoothly.

Figure 2:
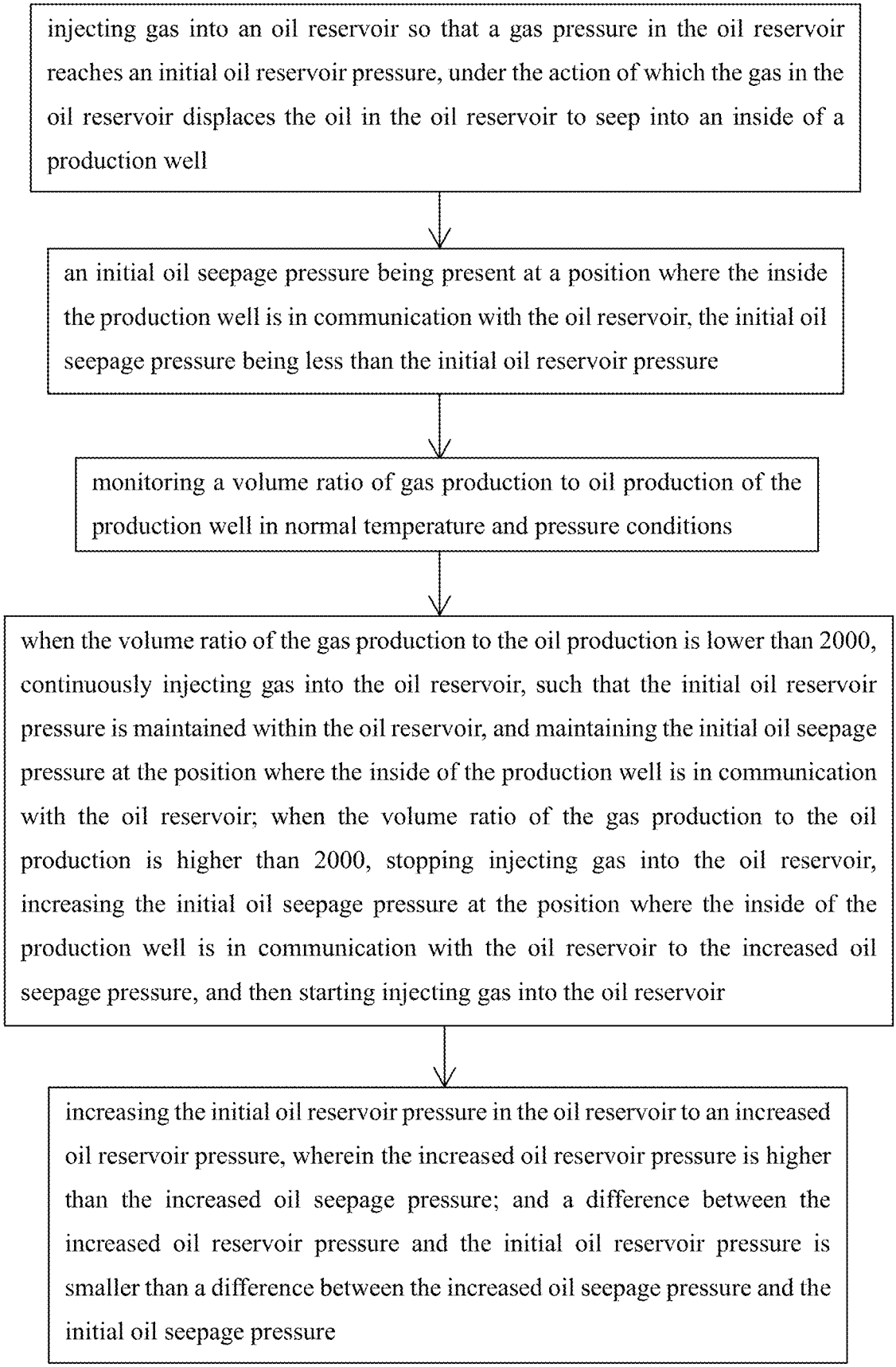
FIG. 2 is another flow chart of a method for oil production by increasing resistance of borehole wall for improving an energy utilization rate of injection gas according to the embodiment 1 of the present disclosure.

Further, as shown in FIG. 2, the present disclosure provides a method for oil production by increasing resistance of borehole wall for improving an energy utilization rate of injection gas, wherein the monitoring gas production and oil production of the production well includes: monitoring a volume ratio of gas production to oil production of the production well, also referred to as GOR (gas oil ratio), in normal temperature and pressure conditions, wherein GOR is a common term in the petroleum industry and refers to the standard cubic feet of gas per barrel of oil, and is a key parameter for measuring economic value.

Further, as shown in FIG. 2, the present disclosure provides a method for oil production by increasing resistance of borehole wall for improving an energy utilization rate of injection gas, wherein when the ratio of the gas production to the oil production is higher than the predetermined ratio, increasing the initial oil seepage pressure at the position where the inside of the production well is in communication with the oil reservoir 6 to the increased oil seepage pressure includes: when the volume ratio of gas production to oil production is higher than 2000 (i.e. the predetermined ratio is 2000), which is considered in the field that the gas forms a channeling flow and no production is performed, closing a valve of the gas injection well 5, stopping the gas injection into the oil reservoir 6, increasing the initial oil seepage pressure at the position where the inside of the production well is in communication with the oil reservoir 6 to the increased oil seepage pressure, and then opening the valve of the gas injection well 5 to start injecting gas into the oil reservoir 6 again for oil displacement; and when the volume ratio of gas production to oil production is lower than 2000, which is considered that no gas channeling occurs, at this time, maintaining normal production process, continuously injecting gas into the oil reservoir, such that the initial oil reservoir pressure is maintained inside the oil reservoir, and the initial oil seepage pressure is maintained at the position where the inside of the production well is in communication with the oil reservoir.

Further, as shown in FIG. 2, the present disclosure provides a method for oil production by increasing resistance of borehole wall for improving an energy utilization rate of injection gas, wherein the method further comprises: increasing the initial oil reservoir pressure in the oil reservoir 6 to an increased oil reservoir pressure to improve gas displacement energy, wherein the increased oil reservoir pressure is higher than the increased oil seepage pressure to ensure that the oil in the oil reservoir 6 can seep into the production well smoothly.

Preferably, as shown in FIG. 2, the present disclosure provides a method for oil production by increasing resistance of borehole wall for improving an energy utilization rate of injection gas, wherein a difference between the increased oil reservoir pressure and the initial oil reservoir pressure is smaller than a difference between the increased oil seepage pressure and the initial oil seepage pressure, that is, an increase of the oil seepage pressure is greater than an increase of the oil reservoir pressure, so as to ensure the limiting effect on the channeling gas, so that the channeling gas is forced to accumulate in the oil reservoir 6 to compress and displace more oil.

Compared with the prior art, the present disclosure has advantages as follows: With the method for oil production by increasing resistance of borehole wall for improving an energy utilization rate of injection gas provided by the present disclosure, when the gas channeling phenomenon occurs, the pressure required for gas channeling flow is increased by increasing the oil seepage pressure at the position where the inside of the production well is in communication with the oil reservoir, so as to reduce occurrence of the gas channeling phenomenon and to force the channeling gas to accumulate in the oil reservoir to compress and displace more oil and increase oil production.

Figure 10:
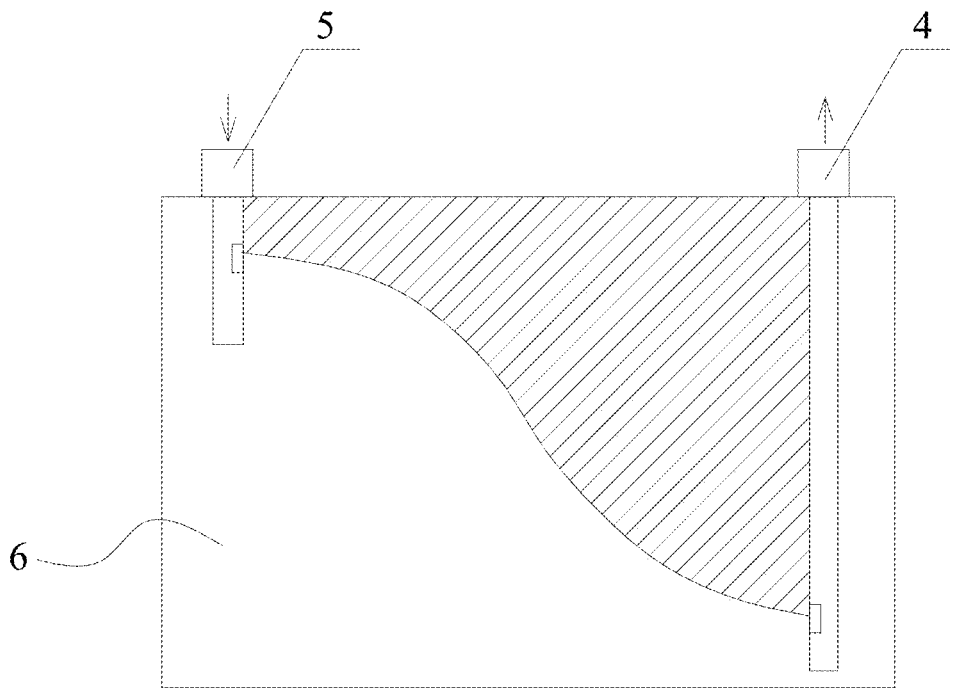
FIG. 10 is a schematic diagram of the reservoir development effect in the prior art.

The extent to which the method for oil production by increasing resistance of borehole wall for improving an energy utilization rate of injection gas provided by the present disclosure increases the recovery ratio depends on factors such as reservoir volume, permeability, heterogeneity, gas injection pressure and production rate, and the like, wherein larger reservoir volume, lower permeability, greater heterogeneity and lower gas injection pressure and the like may cause greater extent to which the method for oil production by increasing resistance of borehole wall for improving an energy utilization rate of injection gas provided by the present disclosure increases the recovery ratio, with reference to FIGS. 10 and 11 in which the shaded area in FIG. 10 indicates the oil displacement area in the prior art, and the shaded area in FIG. 11 indicates the oil displacement area after application of the method for oil production by increasing resistance of borehole wall for improving an energy utilization rate of injection gas provided by the present disclosure, and an increment of the recovery ratio ranges from 8% to 15%.

Embodiment 2

Figure 3:
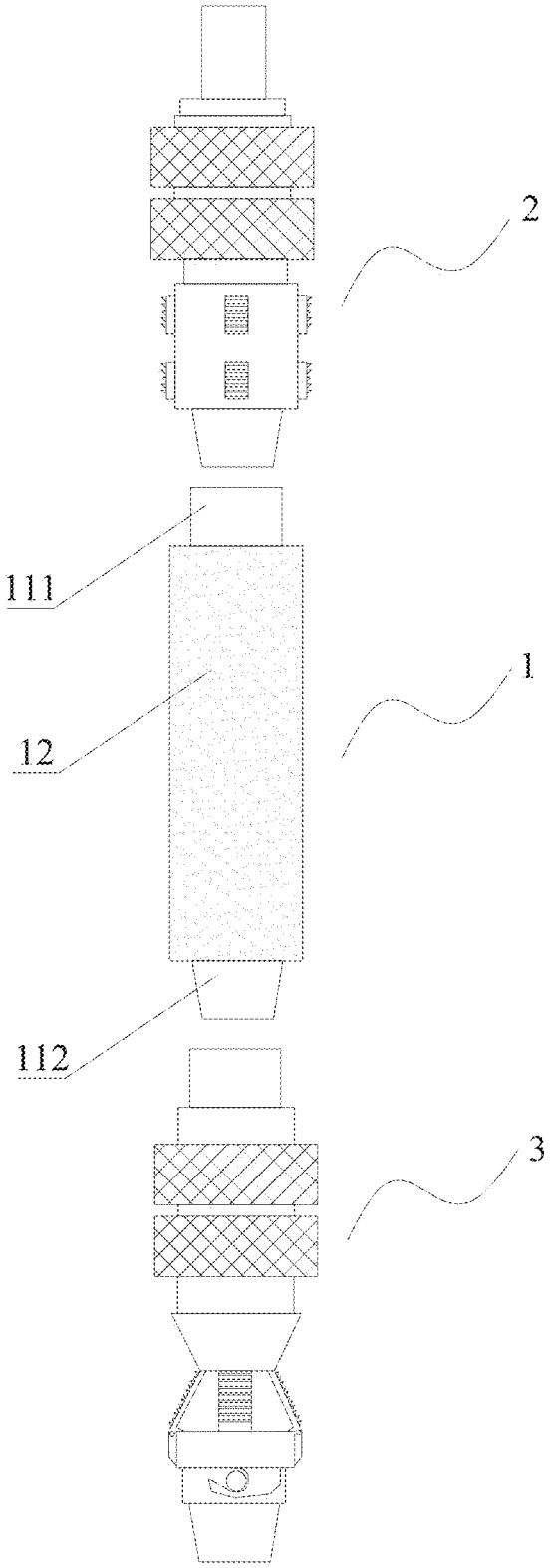
FIG. 3 is a structural schematic of a borehole wall resistance increasing apparatus for improving an energy utilization rate of injection gas according to an embodiment 2 of the present disclosure.
Figure 5:
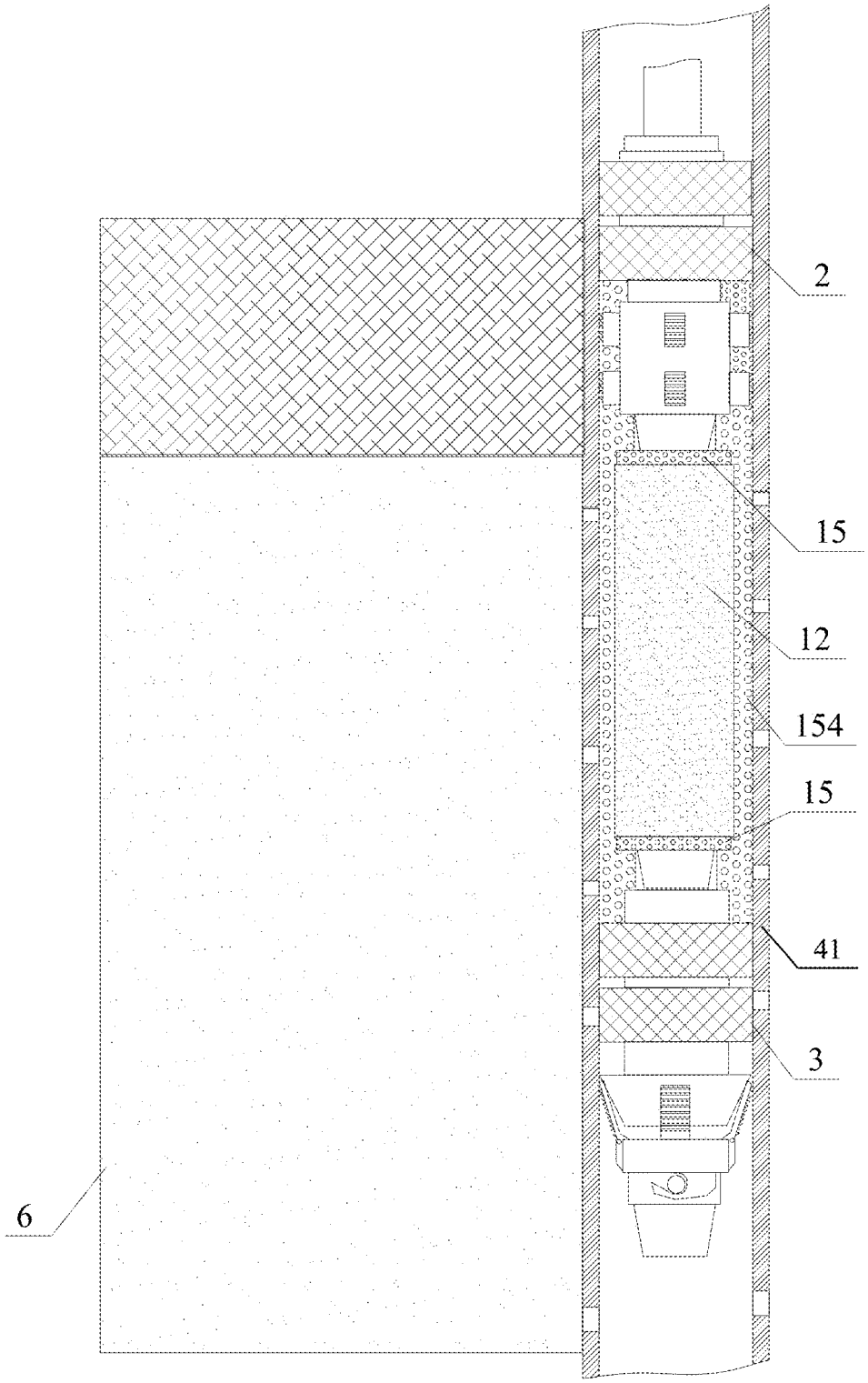
FIG. 5 is a structural schematic of a borehole wall resistance increasing apparatus for improving an energy utilization rate of injection gas according to the embodiment 2 of the present disclosure, in use state.

As shown in FIGS. 3, 5 and 11, the present disclosure further provides a borehole wall resistance increasing apparatus A for improving an energy utilization rate of injection gas, which may also be referred to as an in-well resistance increasing apparatus for improving an utilization rate of injection gas. Specifically, by providing an in-well resistance increasing apparatus for improving an utilization rate of injection gas on an inner wall of an oil well casing of the production well, the pressure of the product in the oil reservoir seeping into the production well is increased so that the gas injected into the oil reservoir accumulates inside the oil reservoir, the pressure in the oil reservoir is maintained, and the gas channeling phenomenon is reduced, that is, the utilization rate of the gas injected into the oil reservoir is improved, wherein the borehole wall resistance increasing apparatus A for improving an energy utilization rate of injection gas is used for implementing the method for oil production by increasing resistance of borehole wall for improving an energy utilization rate of injection gas as described in the embodiment 1.

The borehole wall resistance increasing apparatus A for improving an energy utilization rate of injection gas is provided at a position where an inside of the production well 4 is in communication with the oil reservoir 6, to increase the initial oil seepage pressure at the position where the inside the production well 4 is in communication with the oil reservoir 6 to an increased oil seepage pressure.

The borehole wall resistance increasing apparatus A for improving an energy utilization rate of injection gas comprises an upper packer 2, a resistance increasing mechanism 1, and a lower packer 3 connected sequentially from top to bottom, wherein the upper packer 2 and the lower packer 3 are capable of sealing against the inner wall of the production well 4 (oil well casing 41) above and below the position where the inside of the production well 4 is in communication with the oil reservoir 6, respectively, such that an independently closed annular space communicating with the oil reservoir 6 is formed between the upper packer 2 and the lower packer 3 and between the resistance increasing mechanism 1 and the inner wall of the oil well casing 41 of the production well 4. The oil in the oil reservoir 6 enters the production well 4 and then enters directly into the annular space between the upper packer 2 and the lower packer 3 and comes into contact with the resistance increasing mechanism 1. The oil then seeps and passes through the resistance increasing mechanism 1 and is eventually produced by the production well 4. The resistance increasing mechanism 1 can increase the pressure of the oil seeping into the production well 4 to force the gas in the oil reservoir 6 to accumulate inside the oil reservoir 6.

The resistance increasing mechanism 1 includes: a connecting pipe 11 having an upper end connected to a lower end of the upper packer 2 and a lower end connected to an upper end of the lower packer 3, and provided radially thereon with a plurality of through holes 113 through which the oil flows into the connecting pipe 11; and a resistance increasing sleeve 12, within which the connecting pipe 11 is arranged, which covers the through holes 113, and through which the oil passes in a radial direction thereof. In the process that the oil passes through the resistance increasing sleeve 12 in the radial direction thereof, the resistance increasing sleeve 12 can effectively increase the seepage pressure of the oil, i.e. increase the resistance experienced by the oil during the flow. After passing through the resistance increasing sleeve 12, the oil enters the interior of the connecting pipe 11 through the through holes 113 in the connecting pipe 11, and passes upward through the upper packer 2 into the production well 4 to be produced. Both the upper end of the resistance increasing sleeve 12 and the lower end of the resistance increasing sleeve 12 are closed to ensure that the oil can only pass through the wall of the resistance increasing sleeve 12 in the radial direction of the resistance increasing sleeve 12 into the connecting pipe 11 to avoid the oil from entering the connecting pipe 11 through a gap between the upper end of the resistance increasing sleeve 12 and the connecting pipe 11 and a gap between the lower end of the resistance increasing sleeve 12 and the connecting pipe 11, so as to ensure the seepage pressure of the oil.

The structure of the connecting pipe 11 may be composed of one continuous pipe body or two to more pipe bodies sequentially connected from top to bottom, and the present disclosure is not limited thereto.

Figure 4:
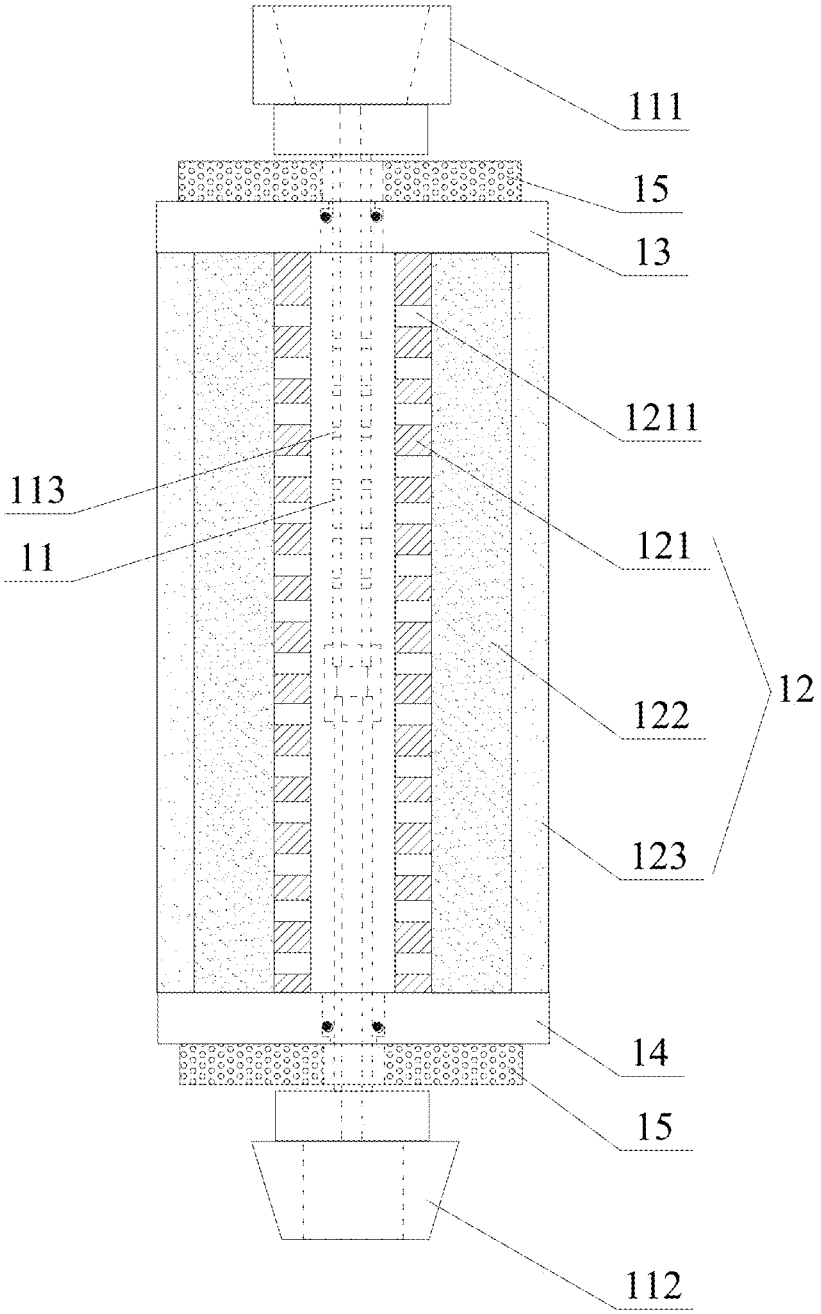
FIG. 4 is a structural schematic of a resistance increasing mechanism of a borehole wall resistance increasing apparatus for improving an energy utilization rate of injection gas according to the embodiment 2 of the present disclosure.
Figure 6:
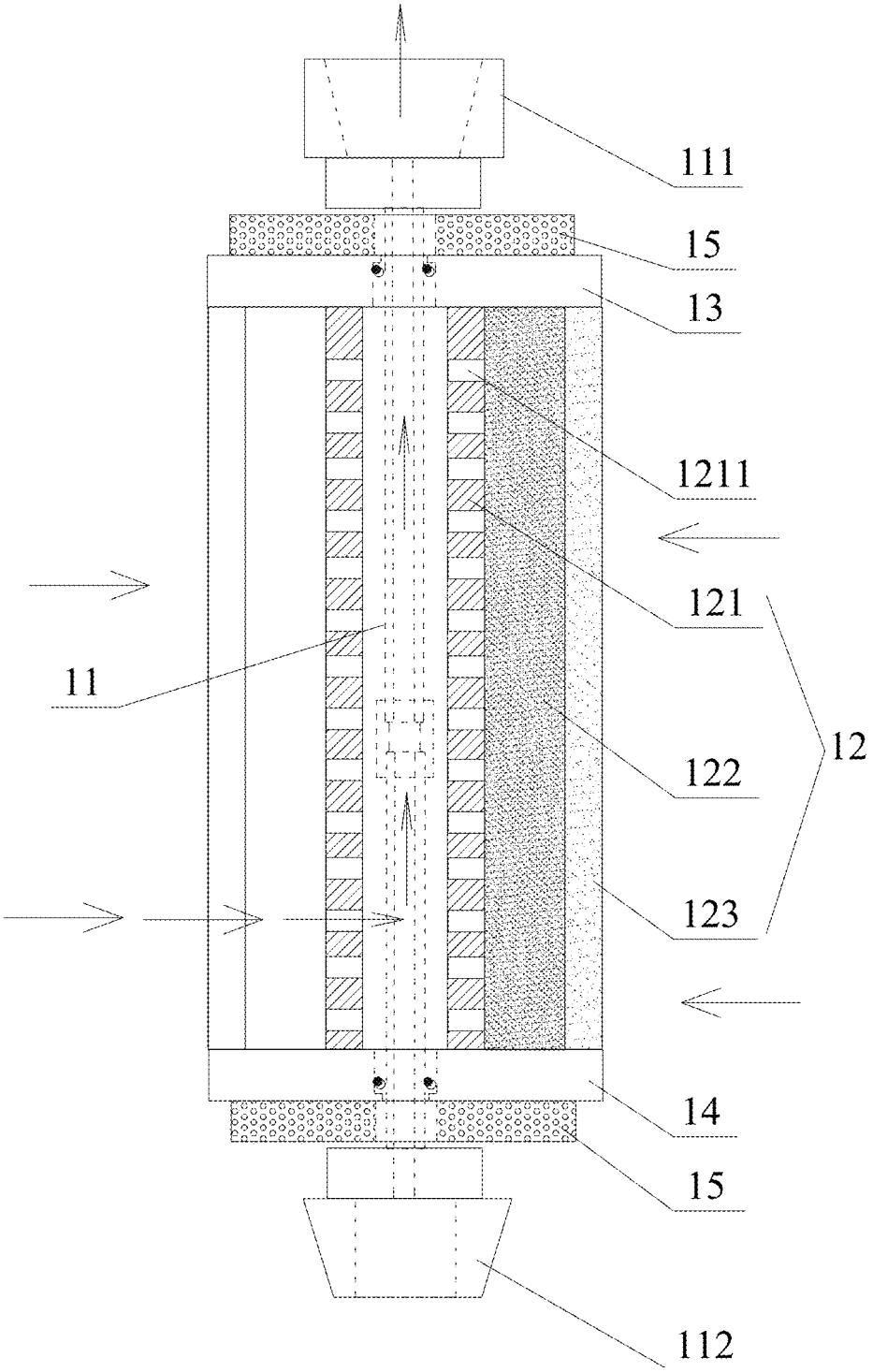
FIG. 6 is a schematic of a flow direction of oil in an oil reservoir in a resistance increasing mechanism of a borehole wall resistance increasing apparatus for improving an energy utilization rate of injection gas according to the embodiment 2 of the present disclosure.

Further, as shown in FIGS. 4 and 6, the present disclosure provides a borehole wall resistance increasing apparatus for improving an energy utilization rate of injection gas, wherein the resistance increasing sleeve 12 includes a reinforcing cylinder 121, a resistance increasing cylinder 122, and a filter cylinder 123 from the inside to the outside in the radial direction of the resistance increasing sleeve 12. The reinforcing cylinder 121 has a function of protecting and supporting the resistance increasing cylinder 122, the resistance increasing cylinder 122 is used to increase the oil seepage pressure, and the filter cylinder 123 is used for filtering solid particles, oil impurities and the like in the oil, so as to prevent the solid particles, oil impurities and the like from directly contacting the resistance increasing cylinder 122 and causing the seepage ability of the resistance increasing cylinder 122 to decrease. Meanwhile, the filter cylinder 123 can also protect the resistance increasing cylinder 122 outside the resistance increasing cylinder 122 to prevent the outer surface of the resistance increasing cylinder 122 from being impacted. A plurality of penetrating eyelets 1211 are provided in an wall of the reinforcing cylinder 121 in the radial direction of the reinforcing cylinder 121. The eyelets 1211 may have a diameter of 1 mm to 5 mm, preferably 2 mm, so that the oil that has passed through the resistance increasing cylinder 122 passes through the reinforcing cylinder 121 smoothly and passes through the through holes 113 in the connecting pipe 11 to enter the interior of the connecting pipe 11. Meanwhile, in order to ensure the structural strength of the reinforcing cylinder 121, the eyelets 1211 are not too large, otherwise the structural strength of the reinforcing cylinder 121 was reduced, thereby failing to provide effective support protection for the resistance increasing cylinder 122.

The length of the reinforcing cylinder 121, the resistance increasing cylinder 122, and the filter cylinder 123 is determined by the thickness of the oil reservoir 6 and the production design, and the length of the reinforcing cylinder 121, the resistance increasing cylinder 122, and the filter cylinder 123 is not limited, provided that the inner wall of the oil well casing 41 of the production well 4 is kept intact. In addition, the reinforcing cylinder 121, the resistance increasing cylinder 122, and the filter cylinder 123 may be formed by connecting a plurality of shorter cylinders in series, and the present disclosure is not limited thereto.

Preferably, the present disclosure provides a borehole wall resistance increasing apparatus for improving an energy utilization rate of injection gas, wherein the resistance increasing cylinder 122 is a sandstone cylinder, i.e. a sandstone cylinder having a specified permeability by means of cementing sand filling and constant pressure pressing. Permeability values are usually designed to be one tenth of the permeability of the applied reservoir. The factors to be considered include the number of sand grains, the amount of glue used, the thickness of the cemented sand body, etc. The sandstone structure is very brittle, so it is easy to be damaged by external forces such as pulling and pressing in the process of lowering and lifting the pipe string, so that it is necessary to provide the reinforcing cylinder 121 to reinforce and support the pipe string, so as to bear external forces such as tension and pressure exerted on the sandstone cylinder, by the reinforcing cylinder 121.

The filter cylinder 123 is a metal cylinder, which is a cylinder that is formed by sintered metallic titanium particles, having uniform permeability, a wall thickness of no more than 5 mm, and having the characteristics of fluid corrosion prevention, uniform pores and low surface roughness. The metal cylinder can effectively protect the intermediate resistance increasing sandstone cylinder from being impacted by hard objects. Because the metal cylinder has a very strong anti-corrosion capability, it can effectively prevent the corrosive fluid from damaging the sealing of the three-layer cylinder. Meanwhile, since the surface of the metal cylinder is relatively smooth, it is not easy to be seized during lifting and lowering, and the friction resistance is small, which is beneficial to smooth movement of the borehole wall resistance increasing apparatus within the casing.

The resistance increasing cylinder 122 has a thickness of 5 mm to 15 mm to ensure the resistance increasing effect of the resistance increasing cylinder 122.

The filter cylinder 123 has a thickness of 3 mm to 5 mm to ensure the structural strength of the filter cylinder 123.

Preferably, as shown in FIGS. 4 and 6, the present disclosure provides a borehole wall resistance increasing apparatus for improving an energy utilization rate of injection gas, wherein the upper end of the resistance increasing sleeve 12 is closed by an upper gland 13, the lower end of the resistance increasing sleeve 12 is closed by a lower gland 14. Both the upper gland 13 and the lower gland 14 are arranged on the connecting pipe 11 in a sealing manner, a lower surface of the upper gland 13 is in sealing contact with an upper end surface of the resistance increasing sleeve 12 (including an upper end surface of the reinforcing cylinder 121, an upper end surface of the resistance increasing cylinder 122, and an upper end surface of the filter cylinder 123), and an upper surface of the lower gland 14 is in sealing contact with a lower end surface of the resistance increasing sleeve 12 (including a lower end surface of the reinforcing cylinder 121, a lower end surface of the resistance increasing cylinder 122, and a lower end surface of the filter cylinder 123), so as to seal the upper and lower ends of the resistance increasing cylinder 12 and prevent the oil from flowing from the upper and lower ends of the resistance increasing sleeve 12 into the interior of the resistance increasing sleeve 12.

Figure 7:
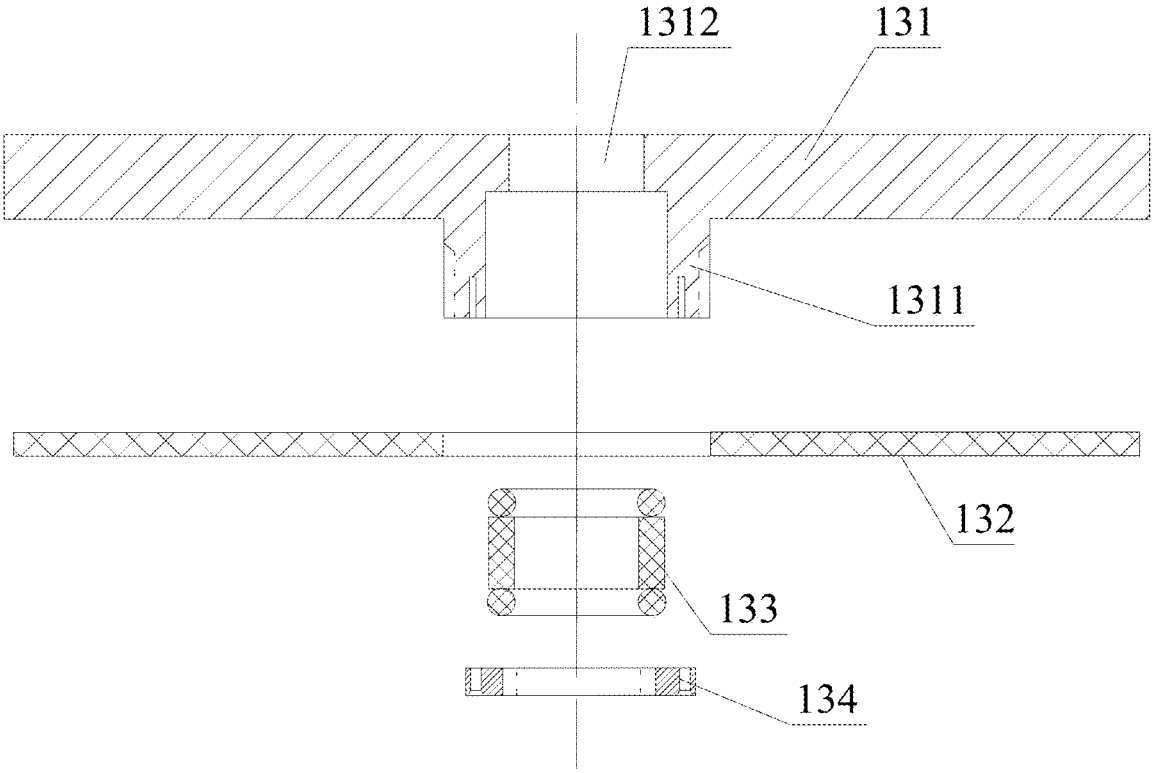
FIG. 7 is an exploded structural schematic of an upper gland of a resistance increasing mechanism of a borehole wall resistance increasing apparatus for improving an energy utilization rate of injection gas according to the embodiment 2 of the present disclosure.
Figure 8:
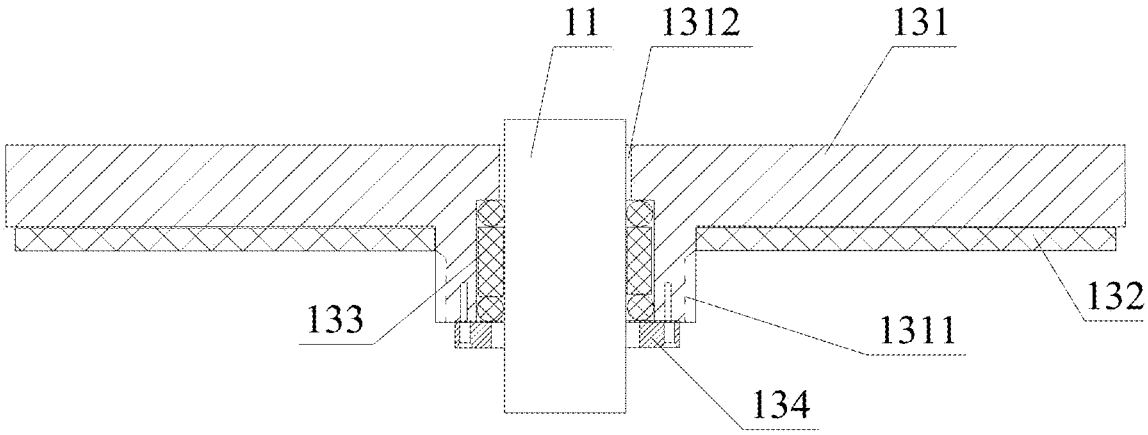
FIG. 8 is a combined structural schematic of an upper gland of a resistance increasing mechanism of a borehole wall resistance increasing apparatus for improving an energy utilization rate of injection gas according to the embodiment 2 of the present disclosure.

Preferably, referring to FIGS. 7 and 8, the specific structure of the upper gland 13 is described in detail as an example, and it is noted that the specific structure of the lower gland 14 is the same as that of the upper gland 13, and the upper gland 13 can be used as the lower gland 14 just by being turned horizontally by 180 degrees.

Specifically, the upper gland 13 includes a cap 131, from a lower surface of which a protrusion 1311 protrudes downward, the cap 131 being disposed coaxially with the protrusion 1311. A penetration hole 1312 penetrating from top to bottom is provided along an axis of the cap 131 and the protrusion 1311. The penetration hole 1312 is a stepped hole having an upper portion of smaller diameter and a lower portion of larger diameter. The connecting pipe 11 penetrates through the stepped hole, and a sealing ring group 133 is arranged between an inner wall of the lower portion of the stepped hole that has the larger diameter and an outer wall of the connecting pipe 11, and the sealing ring group 133 is pressed to the inside of the stepped hole by a pressing ring 134, which may be positioned on the lower end surface of the protrusion 1311 by bolts. The pressing ring 134 has an inner diameter which is larger than the outer diameter of the connecting pipe 11 and smaller than the inner diameter of the protrusion 1311. The outer surface of the protrusion 1311 is formed with external threads for engaging with internal threads on the inner wall of the reinforcing cylinder 121. A sealing gasket 13 is disposed around the protrusion 1311, and is pressingly sealed between the lower end surface of the cap 131 and the upper end surface of the resistance increasing sleeve 12 in a state where the upper gland 13 is in sealing connection with the resistance increasing sleeve 12, so as to form sealing between the lower end surface of the cap 131 and the upper end surface of the reinforcing cylinder 121, between the lower end surface of the cap 131 and the upper end surface of the resistance increasing cylinder 122, and between the lower end surface of the cap 131 and the upper end surface of the filter cylinder 123, such that the oil can seep into the inside of the resistance increasing sleeve 12 only in the radial direction of the resistance increasing sleeve 12.

Preferably, as shown in FIGS. 4 to 6, the present disclosure provides a borehole wall resistance increasing apparatus for improving an energy utilization rate of injection gas, wherein the connecting pipe 11 is provided with a glue storage box 15 above the resistance increasing sleeve 12 and/or below the resistance increasing sleeve 12. The glue storage box 15 can inject and fill foam filler 154 into an annular space between the resistance increasing sleeve 12 and the oil well casing 41 when the resistance increasing mechanism 1 is sealed against and positioned within the oil well casing 41 of the production well 4 by the upper packer 2 and the lower packer 3. Since the oil well casing 41 of the production well 4 is filled with killing fluid and the inner wall or the like of the oil well casing 41 is inevitably smeared with oil contamination, the foam filler 154 occupies most of the annular space between the resistance increasing sleeve 12 and the oil well casing 41, and does not completely seal the annular space between the oil well casing 41 and the resistance increasing sleeve 12. In the process that the foam filler 154 fills the annular space between the oil well casing 41 and the resistance increasing sleeve 12, due to the existence of killing fluid and oil impurities, a number of fine channels through which the oil passes will be formed in the interior of the foam filler 154, thereby not only forming and retaining channels through which the oil flows, but also suppressing the accumulation of gas in the annular space, which is beneficial to the seepage of the oil phase.

Figure 9:
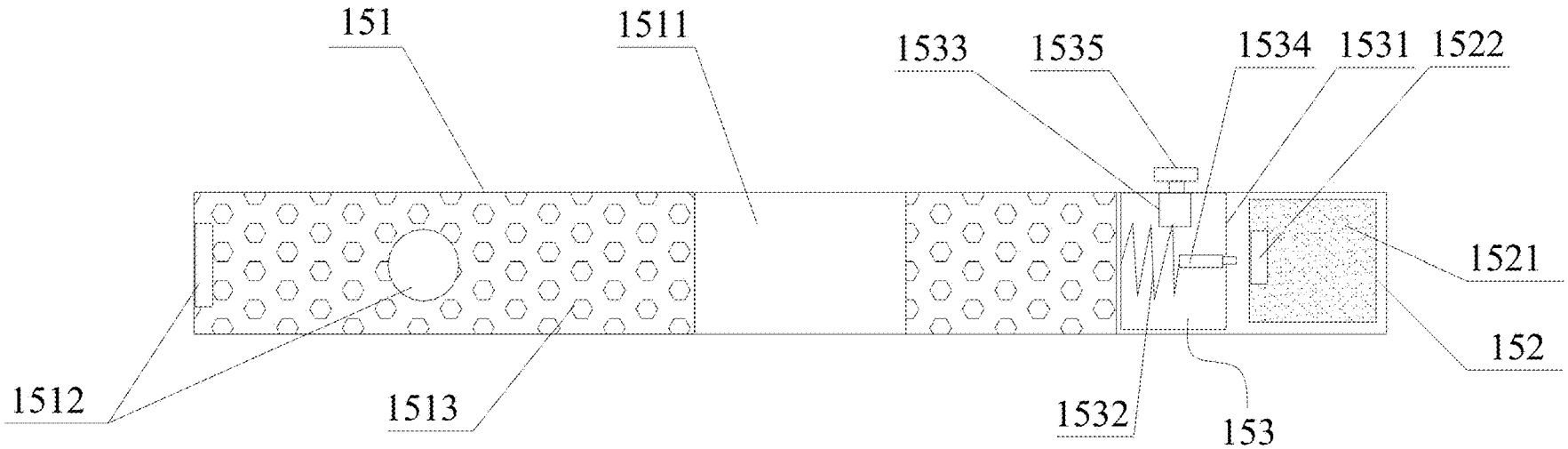
FIG. 9 is a structural schematic of a glue storage box of a resistance increasing mechanism of a borehole wall resistance increasing apparatus for improving an energy utilization rate of injection gas according to the embodiment 2 of the present disclosure.

Preferably, as shown in FIG. 9, the present disclosure provides a borehole wall resistance increasing apparatus for improving an energy utilization rate of injection gas, wherein the glue storage box 15 includes an annular disk-shaped box body 151, which is provided in the center thereof with a penetration hole 1511 through which the connecting pipe 11 penetrates. The box body 151 is filled with a first reactant 1513. A storage bag 152 and a timing syringe 153 are provided within the box body 151. The storage bag 152 contains and is filled with a second reactant 1521. The first reactant 1513 may be a mixture of polyurethane and sodium bicarbonate powder, and the second reactant 1521 may be an aqueous aluminum sulfate solution. The timing syringe 153 can puncture the storage bag 152 at the end of a set time countdown, such that the first reactant 1513 and the second reactant 1521 are mixed within the box body 151 to generate the foam filler 154. The foam filler 154 bursts through the box body 151 and is injected and filled into the annular space between the resistance increasing sleeve 12 and the oil well casing 41. Specifically, the aqueous aluminum sulfate solution is mixed with the sodium bicarbonate powder to generate gas, and when the gas pressure within the box body 151 increases to a set value, the box body 151 ruptures, and the polyurethane expands and enters the annular space between the resistance increasing sleeve 12 and the oil well casing 41 to play the role of filling. It should be noted that the specific component of the first reactant 1513 and the specific component of the second reactant 1521 as described above are only preferred embodiments of the present disclosure. Those skilled in the art may also use other materials for reaction to obtain the foam filler 154, and the present disclosure is not limited thereto.

Preferably, as shown in FIG. 9, the present disclosure provides a borehole wall resistance increasing apparatus for improving an energy utilization rate of injection gas, wherein the timing syringe 153 includes a cylinder body 1531, a spring 1532, a pressing piece 1533, a needle 1534, and a timer 1535. The cylinder body 1531 is provided with a needle exit hole in a surface on a side facing the storage bag 152. The timer 1535 is provided outside the cylinder body 1531. The pressing piece 1533 is provided within the cylinder body 1531. A portion of the timer 1535 extends into the interior of the cylinder body 1531 and connects with the pressing piece 1533. The spring 1532 is positioned within the cylinder body 1531 in a compressed state by the pressing piece 1533, one end of the spring 1532 is connected with the inner wall of the cylinder body 1531, and the other end of the spring 1532 is connected with one end of the needle 1534. The other end of the needle 1534 corresponds to the needle exit hole. The timer 1535 can drive the pressing piece 1533 to be separated from the spring 1532 after the set time countdown ends. For example, as shown in the figure, the timer 1535 can drive the pressing piece 1533 to move upward, so that the pressing piece 1533 cannot block the spring 1532 any longer. The spring 1532, under the action of its elastic restoring force, pushes the needle 1534 out of the needle exit hole to the outside of the cylinder body 1531 to pierce the storage bag 152, and causes the second reactant 1521 in the storage bag 152 to react with the first reactant 1513 in the box body 151, wherein the timing period of the timer 1535 can be set according to the oil reservoir position and a position where the apparatus according to the present disclosure is lowered into the oil reservoir as well as the time required for installation of the apparatus, and the present disclosure is not limited thereto.

Preferably, as shown in FIG. 9, the present disclosure provides a borehole wall resistance increasing apparatus for improving an energy utilization rate of injection gas, wherein a plurality of fragile areas 1512 are formed on a side wall of the box body 151 to facilitate the gas within the box body 151 to burst it and allow the foam filler 154 to enter and fill the annular space between the oil well casing 41 and the resistance increasing sleeve 12. Moreover, a fragile area 1522 is formed on the storage bag 152 at a location opposite the needle exit hole so that the needle 1534 can smoothly puncture the storage bag 152 and allow the second reactant 1521 to react in contact with the first reactant 1513.

Preferably, as shown in FIGS. 3 to 6, the present disclosure provides a borehole wall resistance increasing apparatus for improving an energy utilization rate of injection gas, wherein the upper end of the connecting pipe 11 is connected with an upper joint 111 for connecting with the upper packer 2, and the lower end of the connecting pipe 11 is connected with a lower joint 112 for connecting with the lower packer 3.

Preferably, the present disclosure provides a borehole wall resistance increasing apparatus for improving an energy utilization rate of injection gas, wherein the upper packer 2 is a Y455 packer, that is, a lower tool setting and unpacking, bidirectional slip compression packer, and the lower packer 3 is a Y221 packer, that is, a rotating pipe string setting, lifting and releasing pipe string unsealing, one-way slip compression packer. It should be noted that the types of the upper packer 2 and the lower packer 3 are not limited to the above two types, and other types of packers can be selected as long as the upper and lower sides of the resistance increasing mechanism 1 are respectively packed to form independent annular spaces, and the present disclosure is not limited thereto.

Compared with the prior art, the present disclosure has advantages as follows: With the method and the apparatus for oil production by increasing resistance of borehole wall for improving an energy utilization rate of injection gas provided by the present disclosure, when the gas channeling phenomenon occurs, the pressure required for gas channeling flow is increased by increasing the oil seepage pressure at a position where an inside of the production well is in communication with the oil reservoir, so as to reduce occurrence of the gas channeling phenomenon, and at the same time, to force the channeling gas to accumulate in the oil reservoir to compress and displace more oil and increase oil production. With reference to FIGS. 10 and 11, the shaded area in FIG. 10 indicates the oil displacement area in the prior art, and the shaded area in FIG. 11 indicates the oil displacement area after application of the borehole wall resistance increasing apparatus for improving an energy utilization rate of injection gas provided by the present disclosure, and the oil recovery ratio can be increased by 8% to 15% after adopting the borehole wall resistance increasing apparatus for improving an energy utilization rate of injection gas provided by the present disclosure.

The foregoing is merely an illustrative embodiment of the present disclosure and is not intended to limit the scope of the present disclosure. Any equivalent changes and modifications made by those ordinarily skilled in the art without departing from the concepts and principles of the present disclosure shall fall within the scope of the present disclosure.

The invention claimed is:

1. A borehole wall resistance increasing apparatus for improving an energy utilization rate of injection gas, wherein the borehole wall resistance increasing apparatus is provided at a position where an inside of a production well is in communication with an oil reservoir, and comprises an upper packer, a resistance increasing mechanism, and a lower packer connected sequentially from top to bottom, wherein the resistance increasing mechanism includes:

a connecting pipe having an upper end connected to the upper packer and a lower end connected to the lower packer, and provided radially thereon with a plurality of through holes; and a resistance increasing sleeve within which the connecting pipe is disposed, wherein the resistance increasing sleeve covers the through holes, oil passes through the resistance increasing sleeve in a radial direction of the resistance increasing sleeve, the resistance increasing sleeve can improve the resistance experienced by the oil during the flow, and the resistance increasing sleeve has an upper end and a lower end both being closed, wherein the resistance increasing sleeve includes a reinforcing cylinder, a resistance increasing cylinder, and a filter cylinder from inside to outside in the radial direction of the resistance increasing sleeve, and a plurality of penetrating eyelets are provided in a wall of the reinforcing cylinder in the radial direction of the reinforcing cylinder, and wherein the resistance increasing cylinder is a sandstone cylinder, and the filter cylinder is a metal cylinder.

2. The borehole wall resistance increasing apparatus for improving an energy utilization rate of injection gas according to claim 1, wherein the resistance increasing cylinder has a thickness of 5 mm to 15 mm.

3. The borehole wall resistance increasing apparatus for improving an energy utilization rate of injection gas according to claim 1, wherein the filter cylinder has a thickness of 3 mm to 5 mm.

4. The borehole wall resistance increasing apparatus for improving an energy utilization rate of injection gas according to claim 1, wherein the upper end of the resistance increasing sleeve is closed by an upper gland, the lower end of the resistance increasing sleeve is closed by a lower gland, both the upper gland and the lower gland are sealed against and provided on the connecting pipe, a lower surface of the upper gland is in sealing contact with an upper end surface of the resistance increasing sleeve, and an upper surface of the lower gland is in sealing contact with a lower end surface of the resistance increasing sleeve.

5. The borehole wall resistance increasing apparatus for improving an energy utilization rate of injection gas according to claim 1, wherein the connecting pipe is provided with a glue storage box above the resistance increasing sleeve and/or a glue storage box below the resistance increasing sleeve, and when the resistance increasing mechanism is sealed against and positioned within an oil well casing of the production well by the upper packer and the lower packer, the glue storage box can inject and fill foam filler into an annular space between the resistance increasing sleeve and the oil well casing.

6. The borehole wall resistance increasing apparatus for improving an energy utilization rate of injection gas according to claim 5, wherein the glue storage box includes an annular disk-shaped box body, the box body is formed in the center thereof with a penetration hole through which the connecting pipe penetrates, the box body is filled with a first reactant, a storage bag and a timing syringe are provided within the box body, the storage bag contains and is filled with a second reactant, the timing syringe can puncture the storage bag at the end of a set time countdown, such that the first reactant and the second reactant are mixed within the box body to generate the foam filler, which bursts through the box body and is injected and filled into the annular space between the resistance increasing sleeve and the oil well casing.

7. The borehole wall resistance increasing apparatus for improving an energy utilization rate of injection gas according to claim 6, wherein the timing syringe includes a cylinder body, a spring, a pressing piece, a needle, and a timer, the cylinder body is provided with a needle exit hole in a surface of a side facing the storage bag, the timer is provided outside the cylinder body, the pressing piece is provided within the cylinder body, a portion of the timer extends into the interior of the cylinder body and connects with the pressing piece, the spring is positioned within the cylinder body in a compressed state by the pressing piece, one end of the spring being connected with an inner wall of the cylinder body, the other end of the spring being connected with one end of the needle, and the other end of the needle corresponding to the needle exit hole, the timer can drive the pressing piece to be separated from the spring after the set time countdown ends, and the spring, under the action of its elastic restoring force, pushes the needle out of the needle exit hole to the outside of the cylinder body to pierce the storage bag.

8. The borehole wall resistance increasing apparatus for improving an energy utilization rate of injection gas according to claim 7, wherein a plurality of first fragile areas are formed on side walls of the box body, and a second fragile area is formed in the storage bag at a location opposite the needle exit hole.

9. The borehole wall resistance increasing apparatus for improving an energy utilization rate of injection gas according to claim 1, wherein the upper end of the connecting pipe is connected with an upper joint, and the lower end of the connecting pipe is connected with a lower joint.

* * * * *